United States Patent [19]

Gläser

[11] Patent Number: 4,678,369

[45] Date of Patent: Jul. 7, 1987

[54] METHOD AND ARRANGEMENT FOR SEALING OFF DUMPS TO PREVENT SEEPAGE

[75] Inventor: Eberhard Gläser, Aichwald, Fed. Rep. of Germany

[73] Assignee: Ed. Züblin Aktiengesellschaft, Stuttgart, Fed. Rep. of Germany

[21] Appl. No.: 735,385

[22] Filed: May 17, 1985

[30] Foreign Application Priority Data

May 23, 1984 [DE] Fed. Rep. of Germany ..... 3419163

[51] Int. Cl.[4] ..... B09B 1/00

[52] U.S. Cl. ..... 405/129; 405/53; 405/128

[58] Field of Search ..... 405/52, 53, 128, 129

[56] References Cited

U.S. PATENT DOCUMENTS

| | | | |
|---|---|---|---|
| 2,879,646 | 2/1954 | Brandt | 405/53 |
| 3,307,360 | 3/1967 | Bailly | 405/38 |
| 4,344,722 | 8/1982 | Blais | 405/128 |
| 4,388,357 | 6/1983 | Luebke | 405/53 |
| 4,526,615 | 7/1985 | Johnson | 405/129 |
| 4,543,013 | 9/1985 | Wagner et al. | 405/128 |
| 4,543,016 | 9/1985 | Tallard | 405/52 |

OTHER PUBLICATIONS

"Municipal Landfills Using Double Liners: Seven Case Studies" George R. Schevon, *Waste Age,* Oct. 1985.

*Primary Examiner*—Cornelius J. Husar
*Assistant Examiner*—Kristina I. Hall
*Attorney, Agent, or Firm*—Becker & Becker, Inc.

[57] ABSTRACT

A method and arrangement for vertically sealing off dumps to prevent the seepage of water therefrom. A sealing wall is produced around the dump area which is to be sealed off. The sealing wall has at least one drainage sheet which extends over the length of the sealing wall, and is embedded therein. The drainage sheet produces a hydraulic gradient relative to the surroundings, as a result of which the seepage water collects in the drainage sheet. The occurrence and the quantity of the seepage water accumulated in the drainage sheet is determined in a controlled manner, and is withdrawn from the sealing wall.

23 Claims, 4 Drawing Figures

METHOD AND ARRANGEMENT FOR SEALING OFF DUMPS TO PREVENT SEEPAGE

BACKGROUND OF THE INVENTION

1. Field of the Invention

The present invention relates to a method of vertically sealing off dumps to prevent the seepage of water therefrom, including the step of producing a sealing wall about the dump area which is to be sealed off; the present invention also relates to an arrangement for carrying out this method.

2. Description of the Prior Art

Dumps are indispensible for disposing of garbage, trash, refuse, and other nonusable materials. Only certain materials are allowed to be deposited in a given dump. The intent is to minimize the contamination of the ground and hence the impurities which could enter the ground water. However, due to the manner of collection, and the number of deposits, it is nevertheless impossible to completely avoid the dumping of materials which are contaminated with dangerous materials which are injurious to health. If these materials are water soluble, they are leached from the dump and pass into the ground water. This is, of course, to be avoided under all circumstances.

A horizontal seal (base seal) for dumps has already been proposed, with the effectiveness and reliability thereof being constantly controlled and improved. Guide lines are contained in a pamphlet of the National Council on Refuse entitled "The Systematic Disposition of Refuse". Proposals for vertically sealing off a dump are also known. In circular Nr. 17 of 8/83 of the firm Preussag AG, there is described a vertical sealing by means of a slotted sealing wall, according to which bentonite and plastic materials of bentonite, additives, cement, and water are listed as sealing material. A bentonite-cement suspension is utilized for a method developed in France. Possible leakage from the sealing wall is to be countered by lowering the level of the ground water in the dump. However, such a reduction of the level of the ground water is extremely expensive. Tests relating to the suitability and permeability of various sealing materials (bentonite mixtures) are disclosed in publications of Professor Simons, who holds the chair for Foundation Engineering and Soil Mechanics at the Technical University at Braunschweig. The water tightness or permeability achieved was, depending upon the mixture ratios and setting time, in the range of from $k=10^{-11}$ (m/s) to $10^{-8}$ (m/s). The main problem of all of these heretofore known methods is the leakage of the sealing layers, which although it is relatively small, is nonetheless not insignificant. Not only the location but also the extent and the control of the leakage are therefore of very great interest.

An object of the present invention is to further improve a method of the aforementioned general type in such a way that any leakage which occurs can be detected and localized, and contaminated seepage water in the sealing wall can be determined in a controlled manner and the escape of the seepage water into the surrounding ground and ground water can be prevented.

BRIEF DESCRIPTION OF THE DRAWING

This object, and other objects and advantages of the present invention, will appear more clearly from the following specification in conjunction with the schematic drawing, in which.

SUMMARY OF THE INVENTION

Figure 1:
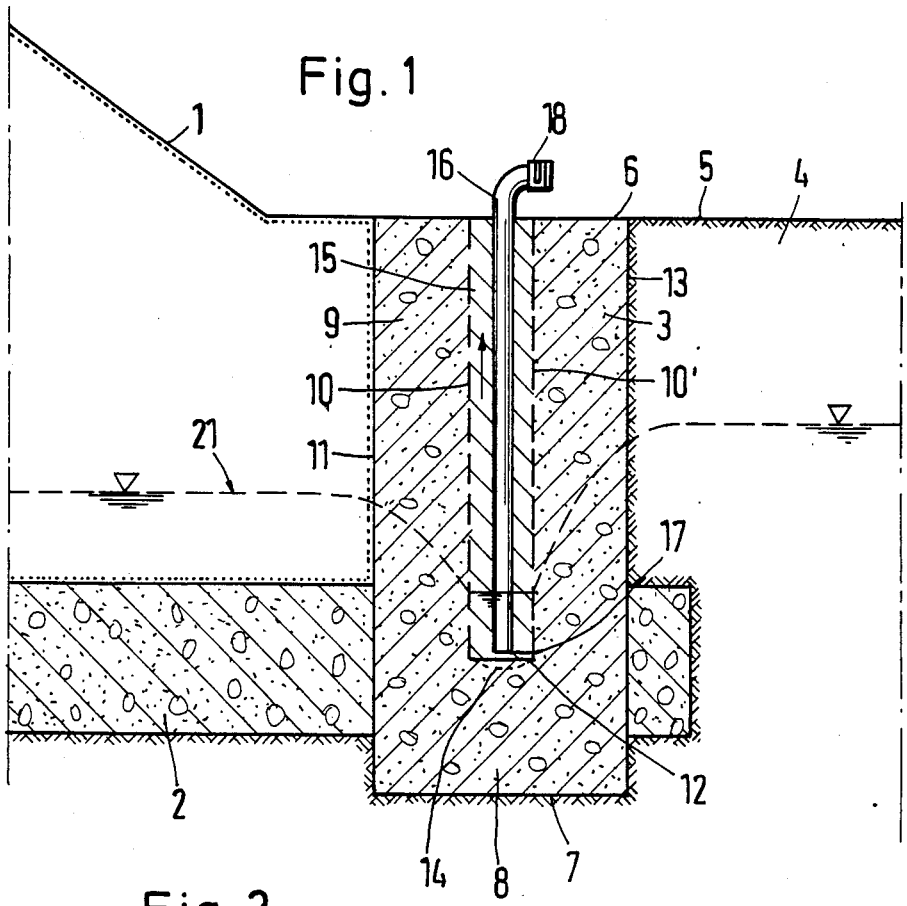
FIG. 1 is a partial sectioned view of a dump surrounded by a sealing wall in which are embedded drainage sheets.

The method of the present invention is characterized primarily in that at least one drainage sheet is provided in the sealing wall and extends substantially over the length thereof; in that a hydraulic gradient relative to the surroundings is produced in the sealing wall, in that the seepage water is collected in the drainage sheets via the hydraulic gradient, in that the occurrence and quantity of the seepage water is determined in a controlled manner; and in that accumulated seepage water is withdrawn from the drainage sheets of the sealing wall.

A vertical sealing wall, in which one or more drainage sheets are embedded, is produced around the dump. The sealing wall extends to an existing base layer or base seal of clay or the like below the dump, and is tightly or sealingly connected with this base layer. The sealing wall can preferably be a slotted wall of concrete, bentonite-cement suspension, casting resin, or similar watertight material which can be poured or hardened. After the excavation of an appropriately deep and wide hole for the supporting wall, the drainage sheet or sheets can be introduced into the hole, and the latter can be filled with sealing material. The drainage sheets could also be introduced into the hole at the same time that the latter is being filled with material for the sealing wall, or the drainage sheets could even be introduced after the sealing wall material has been poured.

After the sealing material has set, both sides of a given drainage sheet are connected with, and hence embedded in, the casting or sealing material. Each drainage sheet preferably comprises a filter-like porous material, the Kf-value (permeability) of which is considerably greater than that of the filling or sealing material of the sealing wall. Thus, pursuant to the present invention, there results between the surrounding sealing material and the drainage sheet a hydraulic gradient which causes the seepage water, which passes from the dump through the sealing material, to collect in the drainage sheet. By means of pipes, channels, or similar outlets which have been disposed at predetermined intervals in the drainage sheet or sealing wall, the control is carried out in such a way that any seepage water which has accumulated is withdrawn at each outlet by being pumped out, suctioned out, gravitationally drained, or by similar measures. The quantity of seepage water withdrawn is measured and permits conclusions to be drawn about the size of the leak and, by correlation to the pipes, about the position of the leak.

Pursuant to the inventive method, the sealing wall, which is preferably embodied as a slotted wall, can be made of individual wall sections, so-called slotted segments for wall elements. Also for reasons of construction, the drainage sheets can preferably also be made of individual sections which are precisely fitted to the slotted sections and can be inserted into the prefabricated slot of the sealing wall. With this type of manufacture of a sealing wall, at least one control opening or outlet is expediently associated with each slotted section. Furthermore, each control outlet is expediently checked at regular or irregular intervals to determine whether any seepage water has accumulated. As the seepage water is withdrawn from the drainage sheet, the hydraulic gradient is increased relative to the surrounding sealing wall, so that a satisfactory operation is always assured.

Preferred embodiments and further developments of the inventive method and arrangement for accomplishing this method, as well as further advantages and important details, will be described subsequently.

DESCRIPTION OF PREFERRED EMBODIMENTS

Referring now to the drawing in detail, there is disposed below the dumps 1 of FIGS. 1 to 3 a horizontal base layer or base seal 2, which can, for example, comprise a bed of clay. The dump 1 is surrounded all the way around by a sealing wall 3. This sealing wall 3 is disposed in a hole previously excavated in the ground 4; the sealing wall 3 extends vertically downwardly from the surface 5 of the ground to the base seal 2, with which the sealing wall 3 is tightly connected. The top edge 6 of the sealing wall 3 is disposed in the plane of the surface 5 of the ground, and the bottom surface 7 of the sealing wall 3 is disposed below the plane of the base seal 2.

The sealing wall 3 is initially embodied as a so-called slotted wall, with a vertical slot being provided in the central portion of the sealing wall; this slot extends downwardly from the top edge 6, and ends approximately at a level corresponding to the center of the base seal 2. The thickness of the bottom portion 8 of the sealing wall 3 disposed below the slot is in this embodiment greater than the thickness of the side portion 9 of the sealing wall 3 facing the dump 1. Disposed in the sealing wall 3 there is a drainage sheet 15 with two outer sides 10, 10' which are spaced from, and extend parallel to, one another; the outer sides 10, 10' are vertically disposed in the central portion of the sealing wall 3, and extend over the entire length of the sealing wall 3 (i.e. over the length of the slot thereof) from the top edge 6 downwardly to the level of the central plane of the base seal 2. The thickness of the side portion 9 of the sealing wall 3 thus extends from the outer side 10 to the supporting surface 11, which faces the dump 1, while the thickness of the bottom portion 8 of the sealing wall 3 extends from the bottom 12 of the drainage sheet 15 to the bottom surface 7 of the sealing wall 3. The distance of the outer side 10 from the supporting surface 11 is preferably equal to the distance of the outer side 10' from the opposite outer surface 13 of the sealing wall 3. The distance between the outer side 10 and the parallel outer side 10' can be equal to approximately one-fourth of the total thickness of the sealing wall 3. However, it is to be understood that it is within the scope of the present invention to select any other distance ratio in conformity to existing requirements. A channel 14 may be provided at the bottom 12 of the drainage sheets 10, 10' in order to collect water which may seep out of the dump 1; however, this collecting channel 14 is not necessarily required, since the seepage water accumulates on its own in the drainage sheet 15.

The drainage sheet 15 in the outer sides 10, 10' can preferably be provided with filter plates, filtering tissues or sheets, or a fleece. A coarse-grained or otherwise porous material can be provided for the drainage sheet 15 in the sealing wall 3. The important thing is that the water permeability of the material of the drainage sheet 15, to the extent possible, be significantly greater than the permeability Kf of the material of the sealing wall 3. To produce the sealing wall 3 itself, a material which can be poured is preferably used, for example concrete, cement-bentonite suspension, or casting resin. The principle is that the drainage sheet 15 disposed in the sealing wall 3 comprises a porous material having a high water permeability.

Figure 2:
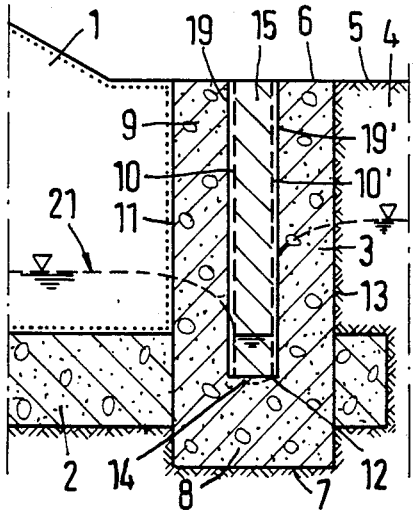
FIG. 2 is a partial sectioned view of a further inventive embodiment which is additionally provided on both sides with sealing foils in the sealing wall.

In the embodiment of FIG. 1, a vertical suction pipe 16 is embedded in the drainage sheet 15 in the center of the sealing wall 3; the intake opening 17 of the suction pipe 16 is disposed just above the bottom 12 of the drainage sheets 10, 10'. At the top, the suction pipe 16 has a connector 18 for connection to a suction pump or the like. Any seepage water which collects at the bottom of the drainage sheet 15 can thus be withdrawn upwardly in the direction of the arrow through the suction pipe 16.

It is advantageous, along with the drainage sheet 15, to place in the sealing wall 3 a vertical, laminar or sheet-like sealing member which is associated with these drainage sheets. In the embodiment of FIG. 2, two sealing foils or very thin sealing sheets 19, 19' are provided as the vertical sealing members. These very thin sealing sheets 19, 19' can be embodied as plastic foils, and are respectively disposed on the outer sides 10, 10' of the drainage sheet 15. In other words, for example, the sealing foil 19, when viewed from the supporting surface 11, is disposed on the inner side portion 9 of the sealing wall 3, with the drainage sheet 15 being provided closely thereafter.

Figure 3:
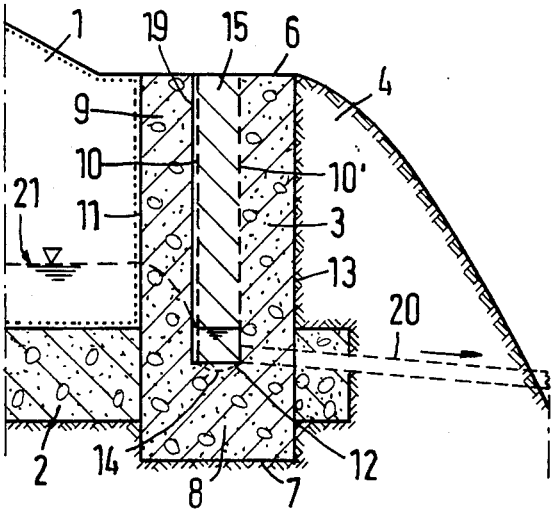
FIG. 3 is a partial sectioned view of an embodiment similar to that of FIG. 2, but with only one additional sealing foil.
Figure 4:
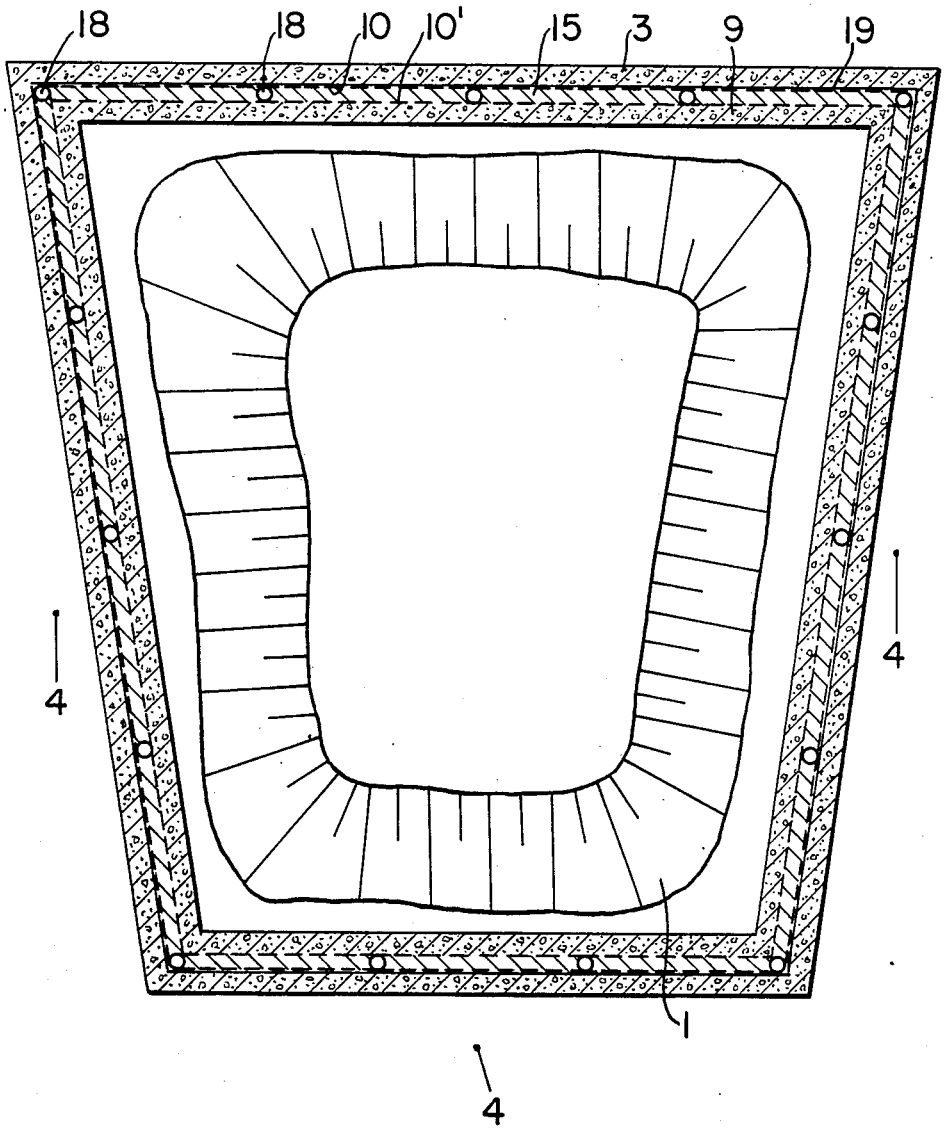
FIG. 4 is a partial sectioned view further showing an overall arrangement of features involved in the present invention.

In the embodiment of FIG. 3, only one sealing foil 19 is provided, and in particular is provided on the inner side of the side portion 9 facing the dump 1. Close to the sealing foil 19, the drainage sheet 15 is also disposed in the sealing wall 3. In this embodiment, in place of the vertical suction pipe 16, there is provided a discharge pipe 20 which proceeds outwardly at an angle from the bottom 12 of the drainage sheet 15 through the sealing wall 3. Any seepage water which collects at the drainage sheet 15 can be withdrawn in a simple manner, via so-called gravitational drainage, through this discharge pipe 20 essentially without special precautions.

A plurality of suction pipes 16 or discharge pipes 20 are provided in the sealing wall 3 in the longitudinal direction at regular or irregular intervals. The sealing wall 3 can be manufactured by initially introducing and possibly fixing the drainage sheet 15 in the previously excavated hole. The sealing wall material is thereafter introduced into the hole, for example by pouring concrete, cement-bentonite suspension, or casting resin therein.

After the poured material has set, the sealing wall 3 is completed, and the drainage sheet 15, as well as the possibly provided sealing foils 19, 19', are embedded therein. The method can expediently also be carried out in such a way that the drainage sheet 15 are placed into the hole essentially at the same time that the sealing wall material is being poured therein, so that the manufacture of the sealing wall 3 is practically effected in a single stage or operation. Furthermore, it can be advantageous to embody the sealing wall 3 as a prefabricated wall element, preferably with the drainage sheets 10, 10', instead of pouring the sealing wall 3 at the site. The thus prefabricated wall elements can then be placed into the excavated hole, with the joints or abutting areas being appropriately filled or sealed off, so that a continuous sealing wall 3 is formed all the way around the dump 1.

As a result of the inventive drainage sheet 15, a hydraulic gradient 21 (shown in dashed lines) is produced from the dump 1 in the direction toward the drainage sheet 15. This hydraulic gradient 21 in the direction toward the drainage sheet 15 can be increased by suctioning off, pumping out, or gravitationally draining the seepage water out of the drainage sheet 15, so that an optimum pressure differential is always achieved for an efficient accumulation of seepage water. The seepage water which has accumulated in the drainage sheet 15 can be withdrawn by the spaced-apart suction pipes 16 or discharge pipes 20, at the same time with a control being possible relative to the quantity of the seepage water and to its occurrence or location. This results in the important advantage that no contaminated seepage water passes into the ground or the ground water.

Pursuant to a further advantageous embodiment of the present invention, a filter, and in particular preferably a woven filter, can be disposed between the sealing wall 3 and the drainage sheet 15 in order to prevent erosion in the vicinity of the sealing wall 3. Advantageously, the porous, water-permeable structure of the drainage sheet 15 is formed from a filter plate, filtering stone, etc. having chemically or physically bound filter granules. It is also conceivable to make the drainage sheet 15 of a permeable support member of any structure and material, preferably of plastic, which is connected at least on one side with a filter-like geotextile. Finally, it is also conceivable to insert the drainage sheet or sheets after the sealing wall material has been poured.

It is to be understood that the method and arrangements of the present invention can also be successfully utilized for other sealing applications, for example for sealing the vertical sealing walls of foundations in the vicinity of the ground water, or for sealing the walls of collection tanks for chemicals, oil, etc.

The present invention is, of course, in no way restricted to the specific disclosure of the specification and drawing, but also encompasses any modifications within the scope of the appended claims.

What I claim is:

1. An apparatus for vertically sealing off dumps to prevent the seepage of water therefrom, including a sealing wall directed upwardly around the dump area which is to be sealed off; said apparatus comprising:

at least one drainage sheet which extends circumferentially around the dump area including the peripheral length of said sealing wall, said drainage sheet having a permeability value greater than that of said sealing wall;

means for producing in said sealing wall a hydraulic gradient relative to the surroundings via liquid level in said drainage sheet lying lower than liquid level in a region externally of the apparatus;

means for collecting said seepage water in said at least one drainage sheet via said hydraulic gradient;

means for determining in a controlled manner the occurrence and quantity of said seepage water; and means for withdrawing accumulated seepage water from said at least one drainage sheet of said sealing wall.

2. An apparatus according to claim 1, which includes a drainage sheet selected from filter plates, a woven filter, filtering tissue, fleece coarse-grained and otherwise porous material.

3. An apparatus according to claim 2, which includes means for providing a space wherein said sealing wall material can be poured, and disposing said at least one drainage sheet into the space, prior to actually pouring said material therein.

4. An apparatus according to claim 3, which includes disposing said at least one drainage sheet into the space, into which the material for said sealing wall is to be poured, at the same time that said material is actually poured therein.

5. An apparatus according to claim 2, which includes disposing said at least one drainage sheet into the space, into which the material for said sealing wall is to be poured, after said material is poured therein.

6. An apparatus according to claim 2, which includes at least one drainage sheet circumferentially over the entire length of said sealing wall, and up to the top edge thereof.

7. An apparatus according to claim 6, which includes disposing at the bottom of said least one drainage sheet in said sealing wall in the vicinity of the central plane of a horizontal base seal disposed below said dump.

8. An apparatus according to claim 7, which includes providing in said sealing wall vertical, sheet-like sealing member means which are associated with said at least one drainage sheet.

9. An apparatus according to claim 8, which includes providing said at least one drainage sheet between two parallel ones of said sheet-like sealing member means.

10. An apparatus according to claim 7, which includes increasing said hydraulic gradient in the direction toward said at least one drainage sheet by withdrawal of seepage water from the latter.

11. An apparatus according to claim 7, which includes controlling the sealing of said sealing wall by withdrawal of seepage water from said at least one drainage sheet through conduit means arranged vertical and inclined.

12. An arrangement for vertically sealing off dumps to prevent the seepage of water therefrom, said arrangement comprising:

a sealing wall which extends circumferentially around the dump area which is to be sealed off; and a very permeable drainage sheet means disposed in said sealing wall, said drainage sheet means comprising porous material having a high water permeability.

13. An arrangement according to claim 12, which includes conduit means, disposed at intervals in said sealing wall, for the withdrawal of seepage water from said drainage sheet means.

14. An arrangement according to claim 12, in which said sealing wall, with said drainage sheet means, is at least one prefabricated wall element.

15. An arrangement according to claim 12, in which said sealing wall includes a supporting surface facing said dump, and an outer surface opposite said supporting surface remote from said dump; said drainage sheet means being vertical arrangement disposed approximately halfway between said supporting surface and said outer surface.

16. An arrangement according to claim 15, in which said drainage sheet means located in said sealing wall comprises two drainage sheets disposed essentially parallel to one another.

17. An arrangement according to claim 16, which includes a suction pipe disposed between said two drainage sheets, which extends to the bottom of the latter, and communicates with at least one of said drainage sheets to enable seepage water to be withdrawn therefrom.

18. An arrangement according to claim 16, which includes channel forming means, for collecting seepage water, in said sealing wall at the bottom of said drainage sheets.

19. An arrangement according to claim 16, which includes sheet-like sealing means disposed in a side portion of said sealing wall between said supporting surface of the latter and one of said drainage sheets.

20. An arrangement according to claim 16, in which said sealing wall is provided further with two parallel sheet-like sealing members, between which is disposed at least one drainage sheet.

21. An arrangement according to claim 15, which further includes a woven filter, for preventing erosion, disposed between said sealing wall and said drainage sheet means.

22. An arrangement according to claim 15, in which the porous, water-permeable structure of said drainage sheet means is formed from a filter structure having bound filter granules.

23. An arrangement according to claim 15, in which said drainage sheet means comprises a permeable support member of predetermined structure and material, and a filter-like geotextile on at least one side of said support member.

* * * * *